United States Patent [19]

Barnes

[11] Patent Number: 4,699,557

[45] Date of Patent: Oct. 13, 1987

[54] REFUSE COLLECTION VEHICLE

[76] Inventor: Kevin P. Barnes, 5287 Aldama St., Los Angeles, Calif. 90042

[21] Appl. No.: 759,763

[22] Filed: Jul. 29, 1985

[51] Int. Cl.[4] ..... B65F 03/04

[52] U.S. Cl. ..... 414/408; 414/409; 414/634

[58] Field of Search ..... 414/406, 407, 408, 409, 414/420, 632, 634, 642, 629

[56] References Cited

U.S. PATENT DOCUMENTS

| | | | |
|---|---|---|---|
| 2,707,063 | 4/1955 | Gran et al. | 414/632 |
| 2,906,419 | 9/1958 | Visco et al. . | |
| 3,140,788 | 7/1964 | Clar . | |
| 3,174,636 | 3/1965 | Dempster et al. . | |
| 3,207,345 | 9/1965 | Ord . | |
| 3,282,453 | 11/1966 | Wood . | |
| 3,961,717 | 6/1976 | Sabine . | |
| 4,363,588 | 12/1982 | Stickney . | |
| 4,450,828 | 5/1984 | Onken et al. . | |

FOREIGN PATENT DOCUMENTS

| | | | |
|---|---|---|---|
| 78011 | 4/1983 | European Pat. Off. | 414/406 |
| 2412096 | 3/1974 | Fed. Rep. of Germany | 414/409 |
| 1389023 | 1/1965 | France | 414/629 |
| 681323 | 10/1952 | United Kingdom | 414/409 |

*Primary Examiner*—Lawrence J. Oresky

*Attorney, Agent, or Firm*—Nilsson, Robbins, Dalgarn, Berliner, Carson & Wurst

[57] ABSTRACT

A refuse collection vehicle has a chassis, a cab mounted to the front of the chassis, a body mounted to the chassis behind the cab for conventional dumping or for modular box transfer and a loading device or assembly. The loading device or assembly comprising forks mounted on a carriage which travels vertically along a mast. The mast being pivotally mounted to arms which are mounted for pivotal movement about an axis located above the cab. The arms rotate the mast rearwardly toward the body. The contents of the container are emptied into the body of the vehicle by moving the forks upwardly along the mast,rotating the lift arm upwardly and rearwardly toward the vehicle body, arm and tilting the forks into the vehicle body. In a preferred embodiment, the forks are attached along the mast arm by a chain drive mechanism carried with the mast.

5 Claims, 8 Drawing Figures

FIG. 1
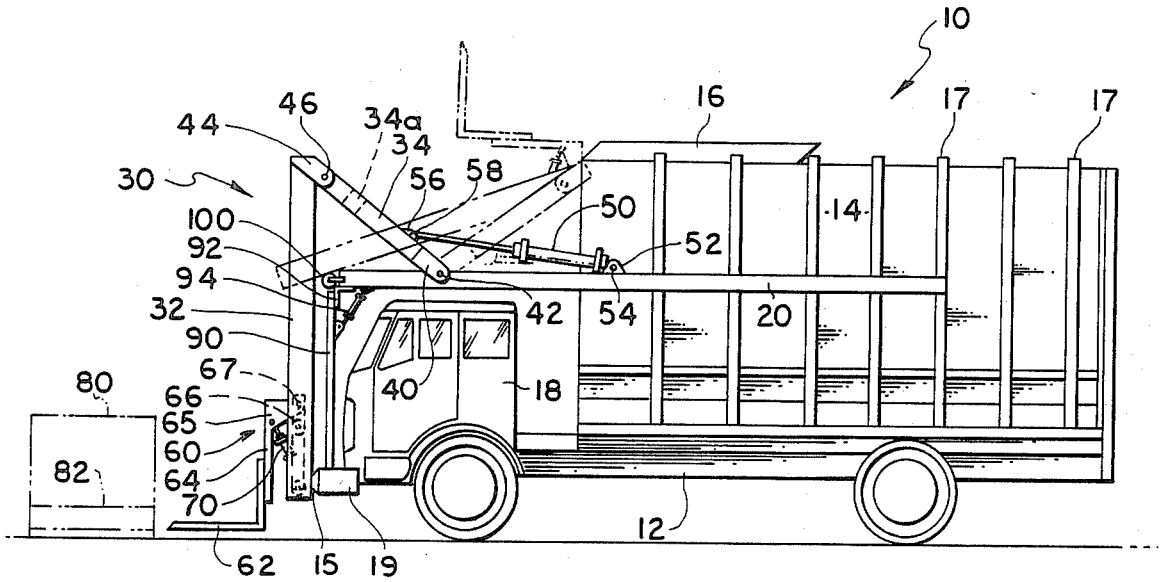
FIG. 2
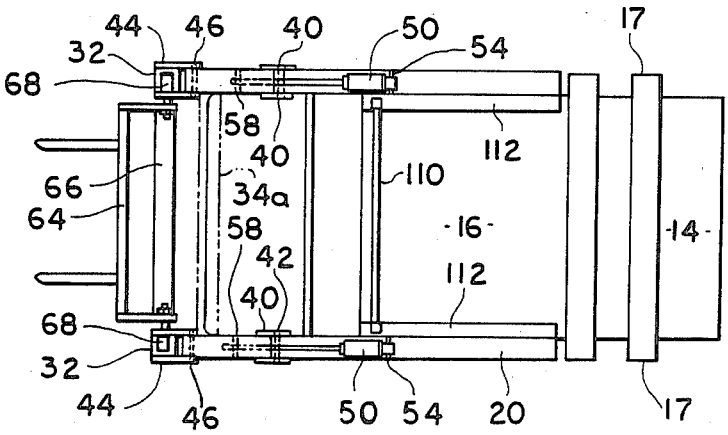
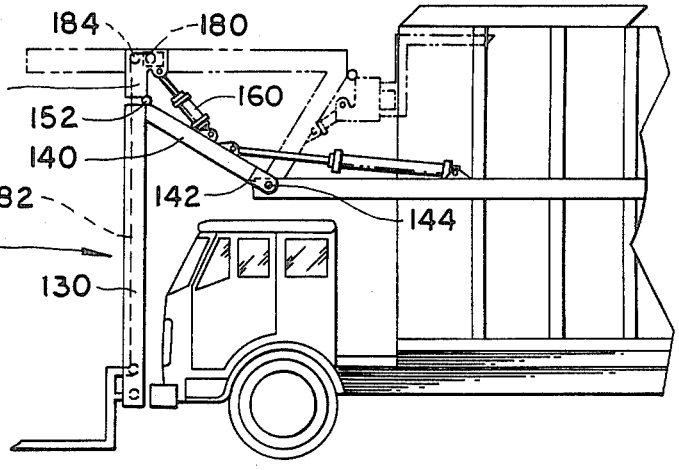
FIG. 4

FIG. 5
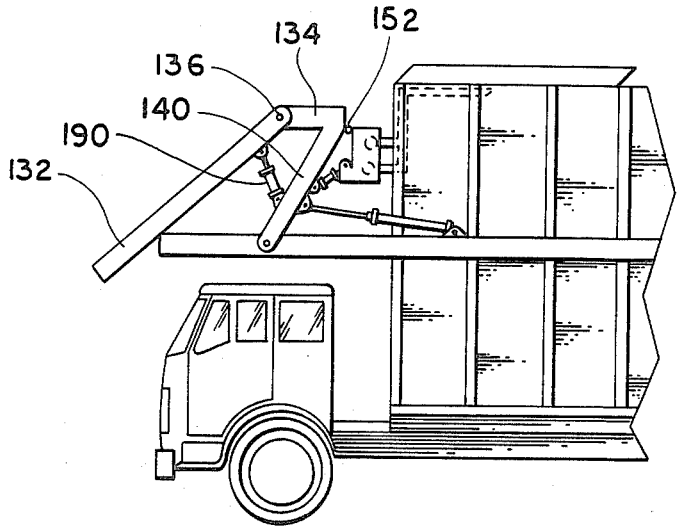
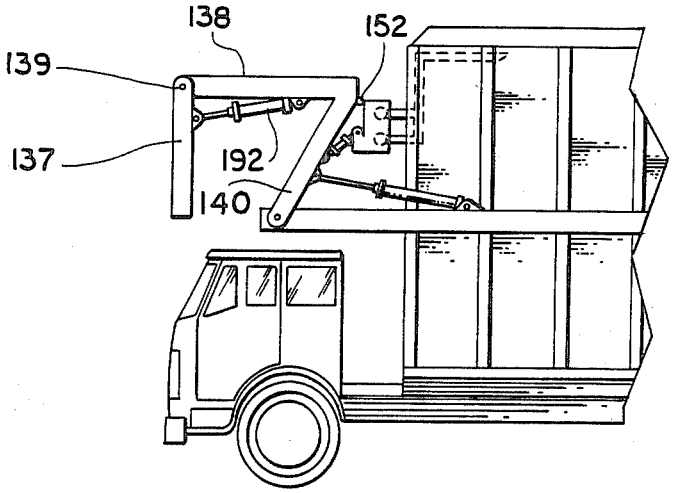
FIG. 6

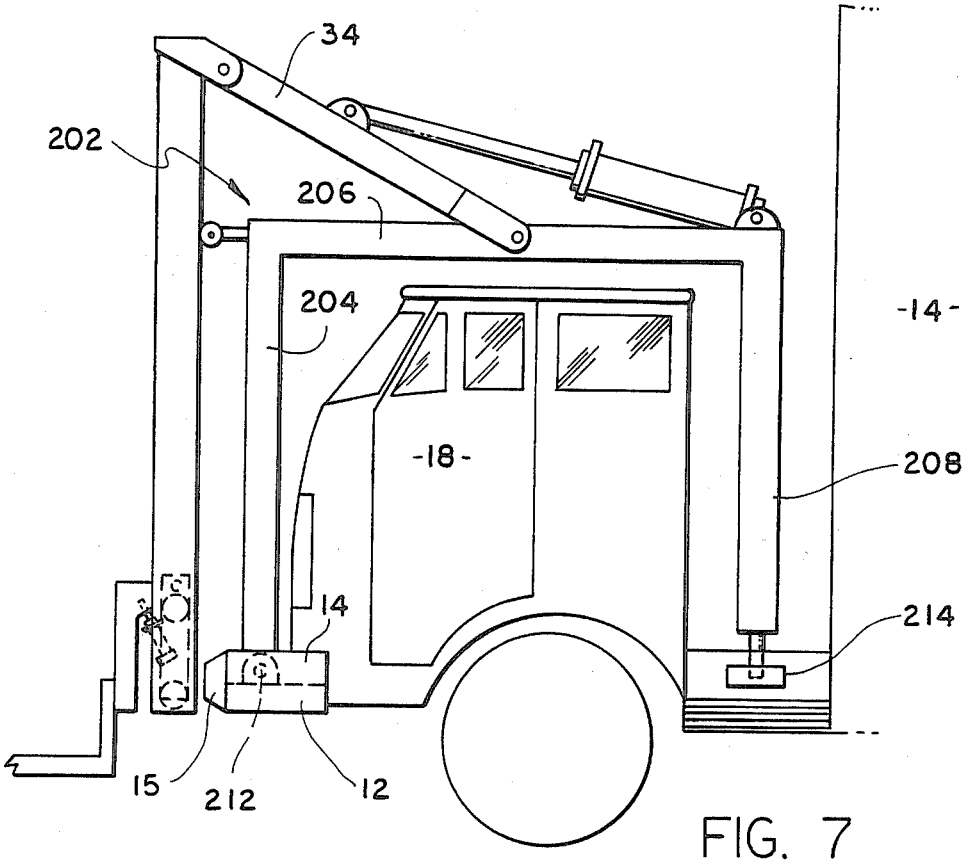
FIG. 7
FIG. 8
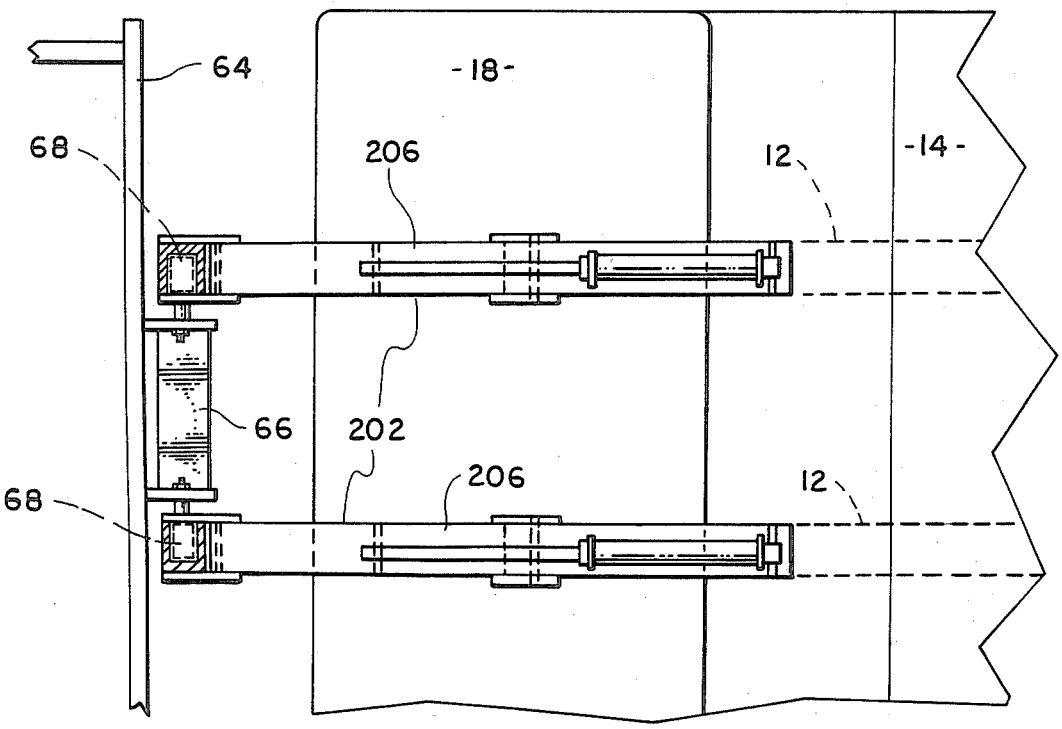

REFUSE COLLECTION VEHICLE

BACKGROUND OF THE INVENTION

The present invention relates generally to the vehicle art and, more particularly, to a lifting apparatus pivotally mounted above the cab of a refuse collection vehicle.

In recent years, businesses and individuals have increasingly relied upon large refuse containers which can be lifted only by mechanical lift devices. The trucks used to transport refuse to a dumping location typically have fork lift-type devices to hoist the container above the vehicle body and tilt it so that the contents are emptied into the vehicle body. One such vehicle is described in U.S. Pat. No. 2,906,419 to Visco, which desribes a rear loading type of lift apparatus. The refuse container is engaged by a fork lift and hoisted above the body of the vehicle by a chain and sprocket drive device. When the container is above the body, it swings down under the force of gravity to dump its contents into the truck body.

Other refuse vehicles, such as that described in U.S. Pat. No. 3,140,788 to Clar, are of the front loading type. The Clar vehicle has a lift arm assembly pivotally mounted to the top front portion of the vehicle body at an elevated location behind the cab to support a fork lift engageable with a refuse container. The lift arm is hoisted above the body by hydraulic cylinders acting on the chassis behind the cab, and the container is inverted to dump its contents by hydraulic cylinders acting between the fork lift and the lift arm assembly.

Another front loading refuse vehicle is described in U.S. Pat. No. 3,207,345 to Ord, wherein a pair of side arms are pivotally mounted to the chassis behind the vehicle cab, a pair of hoist arms are pivotally mounted to outer ends of the side arms, and a fork arrangement is pivotally mounted to the hoist arms. Hydraulic rams mounted to the hoist arm and to the chassis behind the vehicle cab lift the hoist arms, fork arms and container above the vehicle cab. By utilizing a rotary actuator and gravitational forces, the container is rotated so that the contents of the container empty into the open receptacle of the truck body.

A front loading refuse truck having a pair of arcuate channels on each side is described in U.S. Pat. No. 3,282,453 to Wood. A fork-type loader arm is mounted to one pair of channels while tubular spacer elements extend between the loader arm and the second pair of channels. The channels extend between the truck body behind the cab and to the truck bumper, and the loader arm is driven upwardly toward the body by a pair of chain and sprocket mechanisms. The spacer element follows the secondary channel as the loader arm moves and acts to invert the container over the truck body at the appropriate time.

A similar refuse truck is disclosed in U.S. Pat. No. 3,174,636 to Dempster, in which two sets of channel rails are attached to the bumper and the body of the truck. The first channel rails extend vertically from the truck bumper, horizontally over the truck cab, and then downwardly at locations behind the cab. The second channel rails extend vertically from the truck bumper, horizontally below the first channel rails, and then diagonally upwardly to the top of the truck body. A fork apparatus having two sets of rollers are disposed between the first and the second channel rails. An endless chain and sprocket drive located within one of the first channel rails engages one set of rollers to move the fork apparatus along the rails. The relative positioning of the first and second sets of rails causes the fork apparatus to rotate to a position at which the contents of a container are emptied when the fork apparatus reaches the truck body.

The refuse truck most widely used is of the "A" frame type, in which a pair of unitary frames extend up and over the truck cab in a lowered position thereof to support a pair of fork arms in front of the cab. The frames are pivotally attached to the truck chassis or body at a location behind the cab and are acted upon by a pair of ram cylinders mounted to the chassis or body of the truck to pivot the frames upwardly and rearwardly over the cab. The fork arms engage a refuse container and are raised over the truck cab as the frame pivots to empty the contents of the container into the truck body.

The devices described above are usually very heavy, adding up to 3000 lbs to the weight of the vehicle. Because most cities and highway departments place upper limits on the total weight of heavy vehicles, the legal load carrying capacity of a refuse vehicle is reduced by the weight of its chassis and the lift device used. Additionally, most cities and highway departments regulate the width of trucks. This causes the bodies of refuse trucks incorporating "A" frame loading arms to be unduly limited since the hopper opening is located between the arms thereby limiting the width of the hopper opening.

Therefore, there is a current need for a refuse container lift apparatus which is simple, relatively light and does not substantially limit the width of the hopper opening, thereby increasing the load carrying capacity of the truck.

SUMMARY OF THE INVENTION

The present invention resides in a front loading refuse container handling vehicle having a lift arm assembly pivotally mounted at a location above the vehicle cab. In the lowered position, a portion of the lift arm assembly extends vertically in front of the vehicle cab and then downwardly toward the middle top portion of the cab. Fork lift-type arms are mounted to the lift arm assembly to engage the refuse container and enable the container to empty its contents into the vehicle body. A set of hydraulic cylinders have one end attached to the lift arm assembly and are anchored at the other end to position the lift arm assembly toward the vehicle body.

BRIEF DESCRIPTION OF THE DRAWINGS

FIG. 1 is a side view of one embodiment of the present invention.

FIG. 2 is a top view of the present invention as shown in FIG. 1.

FIG. 4 is a side view of another embodiment of the present invention.

FIG. 5 is a side view of another embodiment of the present invention.

FIG. 6 is a side view of another embodiment of the present invention.

FIG. 7 is a side view of another embodiment of the present invention.

FIG. 8 is a top view of the embodiment of the present invention as shown in FIG. 7.

DETAILED DESCRIPTION OF THE PREFERRED EMBODIMENT

Figure 3:
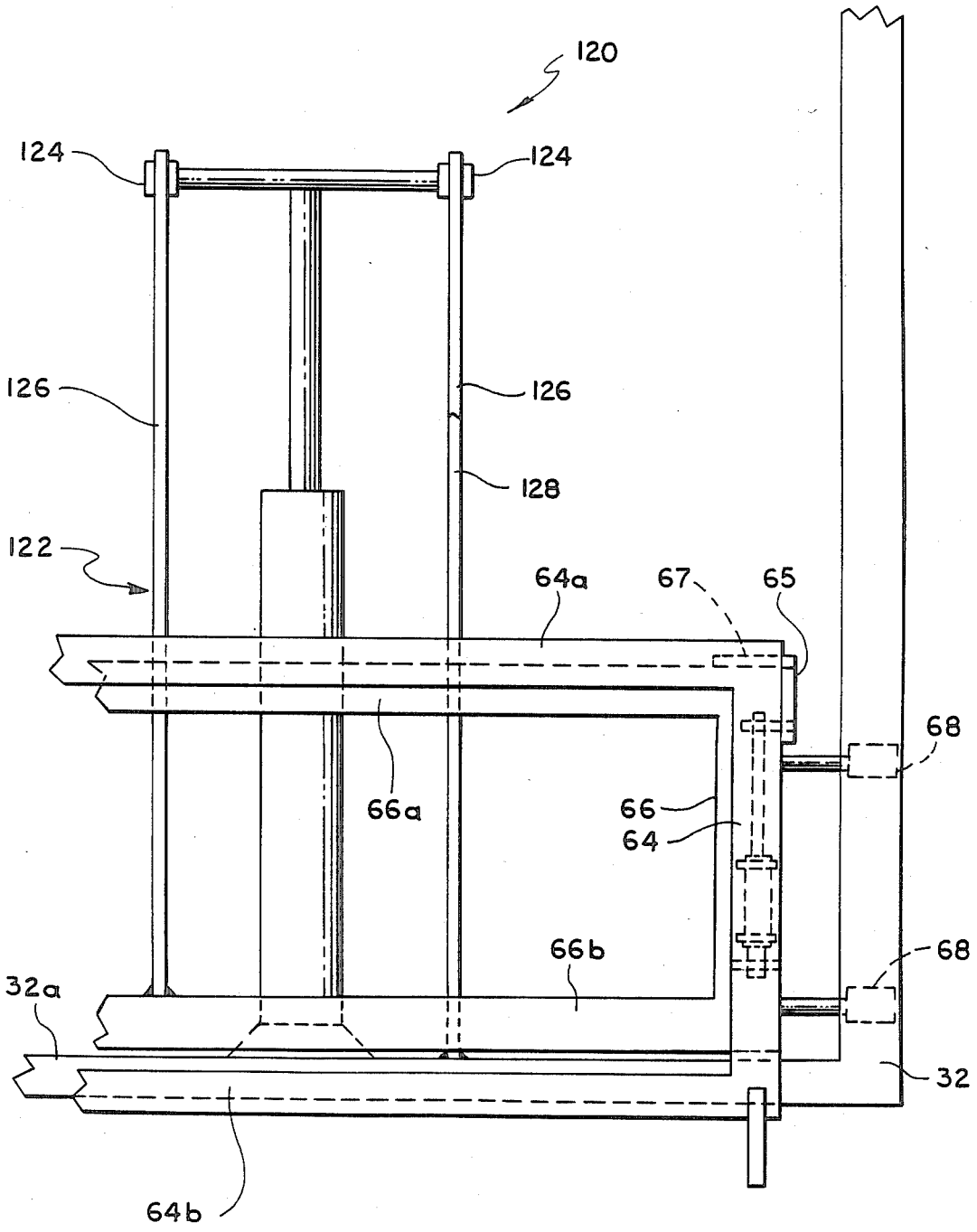
FIG. 3 is a front view of the present invention as shown in FIGS. 1 and 2.

The present invention is a refuse container lift apparatus which weighs less than lift devices in the past and allows maximum possible hopper opening width while keeping the overall width of the vehicle within legal limits. The lift apparatus includes a frame which is pivotally mounted about an axis above and between the front and rear of the vehicle cab. Additionally, the lift apparatus includes a fork lift type device mounted within the frame. The side view of the lift apparatus is seen in FIG. 1 and the top view is seen in FIG. 2. A hydraulic chain and sprocket mechanism as seen in FIG. 3 is mounted to the frame and enables the fork lift device to move along the frame. Once the frame moves to the raised position the fork lift device must tilt backwardly to unload the contents of the refuse container. The fork lift device may tilt backwardly by including a subframe which is driven by a hydraulic actuator as seen in FIG. 4. This method is different from that shown in FIG. 1 wherein the lift device tilts backwardly without the use of a subframe. The use of the subframe requires a different drive mechanism than that shown in FIG. 3. A cable and winch mechanism may move the fork lift device along the frame and is shown in FIG. 4. The amount of overhang of the frame when it is in the raised position may be reduced by articulating the frame at certain points as shown in FIG. 5 and FIG. 6. The frame shown in FIG. 1 to FIG. 6 is pivotally mounted to a pair of support beams which are secured to opposite sides of the vehicle body. Alternatively, the support beams may also be pivotally mounted in front of the vehicle cab as shown in FIG. 7, the top view of which is shown in FIG. 8.

Referring to FIG. 1 a refuse collection vehicle 10 includes a chassis 12 and a body 14 mounted to the chassis 12. The body 14 includes a hopper opening 16 and a plurality of posts 17. Additionally, the refuse collection vehicle 10 includes a vehicle cab 18 attached near the front portion of the chassis 12 and a bumper 19 secured to the front of the vehicle chassis 12. A pair of support beams 20 are secured to opposite sides of the vehicle body 14 and extend horizontally above the vehicle cab 18. The width of the support beams 20 are approximately the same as the width of the body posts 17 and thus does not subtract any width from the hopper opening 16. A lift apparatus frame 30 moves between a lowered position and a raised position (shown in phantom) and comprises a pair of masts 32 and a pair of connecting arm portions 34 which are unitized by a connecting arm cross member 34*a*. A first pair of side plates 40 are secured to one end of the connecting arms 34. The first set of side plates 40 are also attached to the support beams 20 and a first pair of pins 42 are disposed through the side plates 40 and support beams 20 such that the connecting arms 34 may move pivotally about an axis above and between the front and rear of the vehicle cab 18. A second pair of side plates 44 is secured to the top portion of each of the masts 32. Additionally, the second pair of side plates 44 are attached to the other end of the connecting arm portions 34 and a second pair of pins 46 are disposed through the second pair of side plates 44 and the connecting arms 34 such that the masts 32 may move pivotally about an axis relative to the connecting arms 34. A first pair of hydraulic cylinders 50 enable the frame 30 to move between the lowered position and raised position. Each hydraulic cylinder has one end disposed between a first pair of mounting portions 52 on support beams 20. A third pair of pins 54 is disposed through the mounting portions 52 and the hydraulic cylinder 50. The other end of the hydraulic cylinder is disposed between a second set of mounting portions 56 on connecting arms 34. A fourth pair of pins 58 are disposed through the second mounting portions 56 and the hydraulic cylinder 50.

A fork lift device 60 is attached to the mast 32 and includes a pair of fork arms 62. The fork arms 62 are secured to a fork carriage 64 which in turn is secured to one end of a third set of side plates 65. The other end of the third set of side plates 65 is pivotally mounted to a fork sub-carriage 66 which is parallel to the masts 32. A fifth pair of pins 67 is disposed through the third set of side plates 65 and fork sub-carriage 66 to enable the fork lift device 60 to move pivotally about an axis which includes the fifth pair of pins 67. A plurality of rollers 68 are attached to the fork sub-carriage 66 and enables the fork lift device 60 to move along masts 32. Referring to FIG. 2, masts 32 are U-shaped channels which enable the rollers 68 to be disposed within the masts 32. A second pair of hydraulic cylinders 70 in FIG. 1, are attached between the third pair of side plates 65 and fork sub-carriage 66 to tilt the fork lift device 60 backwardly towards the vehicle body 14 when the frame 30 is in the raised position. The fork lift device 60 engages a refuse container 80 by having the fork arms 62 moving within container sleeves 82 which are secured to the refuse container 80.

Occasionally, the refuse container 80 may weigh an excessive amount thereby causing excessive stress on the support beams 20. To enable the present invention to lift heavier refuse containers than the A-frame type of refuse truck, a brace 90 may be mounted to the front portions of the support beams 20 by hinges 92 to alleviate the excessive stress on support beams 20. The brace 90 also engages the top portion of the vehicle bumper 19. Additionally, the brace 90 may also be utilized to reduce the weight of support beams 20. A third pair of hydraulic cylinders 94 are attached between the brace 90 and the support beams 20 to move brace 90 away from the vehicle cab 18 when the cab must be tilted forward for repair or maintenance purposes. A pair of rollers 100 are secured to the front portion of the support beams 20 to support the masts 32 as the frame 30 leaves the lowered position.

A pad 15 may be attached to the front of the bumper 19 to prevent deflection of masts 32 while the container is being raised to the top of masts 32 and to assist the masts from going beyond a vertical position while the frame is in the lowered position.

FIG. 2 shows that the components of the present invention substantially adds to the width of the hopper opening 16. After the contents of the refuse container 80 has been emptied into the body 14 through hopper opening 16, compactor blade 110 moves the refuse material toward the rear portion of the body. The compactor blade 110 is mounted on a pair of rails 112 to perform this task. Additionally, rails 112 can be integrated with support beams 20 to form a unitary support beam rail, thus further saving weight and increasing the hopper opening width over conventional lift devices.

Referring to FIG. 3 the fork carriage 64 includes a top cross beam 64*a* and a bottom cross beam 64*b*. The masts 32 also includes a bottom cross beam 32*a*. A chain and sprocket hydraulic lift mechanism 120 is mounted to the masts bottom cross beam 32*a*, the lift mechanism 120 includes a pair of chains 122 with the front portion 126 attached to the fork sub-carriage bottom cross beam 66*b* and the chains rear portion 128 are attached to the mast bottom cross beam 32*a*. As the hydraulic lift mechanism 120 extends vertically upward, the chains 122 roll around the sprockets 124 and the length of the front portion 126 of the chains 122 decrease while the rear portion 128 of the chains 122 increase, thereby causing the fork lift device 60 to move vertically upward. Additionally, the hydraulic lift mechanism 120 is held in position by conventional methods (not shown).

The sequence of operation by the lift apparatus shown in FIGS. 1 to 3 are as follows. The frame 30 begins in the lowered position and the vehicle 10 moves toward the refuse container 80 until the fork arms 62 engage the container sleeves 82. The chain and sprocket hydraulic lift mechanism 120 then lifts the fork lift device 60 and refuse container 80 vertically upward to the top portion of the masts 32. The first hydraulic cylinders 50 then move the connecting arms 34 towards the vehicle body 14 which moves the masts 32, fork lift device 60 and refuse container 80 towards the vehicle body 14. The second hydraulic cylinder 70 then tilts the fork lift device 60 backwardly to empty the contents of the container 80 into the vehicle body 14 through the hopper opening 16. The sequence of operation then reverses to place the refuse container 80 back to its original location. The frame 30 is in the raised position when the vehicle 10 is traveling from location to location.

An alternative method for tilting the fork lift device 60 backwardly is shown in FIG. 4. The frame 30 includes a pair of mast portions 130 rigidly attached to a pair of connecting arm portions 140. A third set of side plates 142 is secured to the connecting arm portions 140 and is attached to the support beams 20. A pair of sixth pins 144 is disposed through the side plates 142 and the support beams 20 at a point above and between the front and rear of the vehicle cab 18. Therefore, the frame 30 can move pivotally about an axis which includes the pair of sixth pins 144. A subframe 150 is mounted to the top of mast portions 130 by hinges 152. A fourth hydraulic cylinder 160 is mounted between the sub-frame 150 and connecting arm portions 140 to enable the sub-frame 150 to move between a forward position and a backwardly tilted position. The sub-frame 150 is essentially aligned with the mast portions 130 when the sub-frame 150 is in the forward position. Similar to FIG. 3, the fork lift device 60 includes a pair of fork arms 62 attached to a fork carriage 64. The fork lift device 60 in FIG. 4 may move along the masts 32 and sub-frame 150 by utilizing winches 180 mounted to the top of sub-frame 150. The winches 180 extend and retract cables 182 which are secured to the fork carriage top cross beam 64*a*. Additionally, idler pulleys 184 aid the movements of the cables 182. Therefore, winches 180 retract cables 182 when the frame 30 is in the lowered position and the fork arms 62 have engaged the refuse container sleeves 82. The fork lift device 60 then travels vertically upward along the masts 32 and further travel vertically upward to the top of sub-frames 150. The fourth hydraulic cylinders 160 tilt the sub-frame 150 backwardly only when the fork lift device 60 is at the top of sub-frames 150 and the frame 30 has been rotated backwardly toward the hopper opening 16. Therefore, when sub-frame 150 is tilted backwardly, cables 182 are above hinges 152.

When the frame 30 is in the raised position as seen in FIG. 4, part of mast portions 130 are substantially in front of the vehicle cab 18. This excessive overhang by the mast portions 130 is undersirable when the vehicle 10 is traveling from location to location. Therefore, to reduce the amount of overhang, the mast portions 130 may be articulated at a point between the bottom of the mast portions 130 and hinges 152.

Referring to FIG. 5, mast portions 130 are articulated at a point near the hinges 152 such that a pair of first sub-masts 132 are attached to a second pair of sub-masts 134. A seventh pair of pins 136 are disposed through the first sub-masts 132 and second sub-masts 134 to enable the first sub-masts 132 to move pivotally about an axis which includes pins 136. When the lift mechanism is in operation, the first sub-masts 132 are aligned with the second sub-masts 134. However, when the vehicle 10 is traveling from location to location and not in the process of emptying the contents of a refuse container, the first sub-masts 132 are positioned at an angle relative to second sub-masts 134. A fifth pair of hydraulic cylinders 190 are attached between the sub-masts 132 and connecting arms 140 to move the first sub-masts 132 between the aligned position and angled position. As seen in FIG. 5, the amount of overhang by the first sub-masts 132 is reduced when the first sub-masts 132 are in the angled position.

Alternatively, the mast portions 130 may be articulated at a point approximately halfway between the bottom of mast portions 130 and hinges 152 as shown in FIG. 6. The mast portions 130 includes a third pair of sub-masts 137 and a fourth pair of sub-masts 138. The third sub-masts 137 are attached to the fourth sub-masts 138 and eighth pair of pins 139 are disposed through the sub-masts 137 and fourth sub-masts 138 such that the third sub-masts may move pivotally about an axis which includes pins 139. The fourth sub-masts 138 are also rigidly attached to connecting arms 140 similar to that shown in FIG. 5. When the lift apparatus is in operation, the third sub-masts 137 are aligned with fourth sub-masts 138. However, when the lift apparatus is not in operation the third sub-masts 137 are positioned approximately perpendicular to the fourth sub-masts 138. A sixth pair of hydraulic cylinders 192 are attached between the third sub-masts 137 and fourth sub-masts 138 to move the third sub-masts between the aligned position and perpendicular positions. When the third sub-masts 137 are in the perpendicular position as shown in FIG. 6 the amount of overhang by the third sub-masts is substantially reduced.

The winch and cable drive mechanism as described above and shown in FIG. 4 is used when the mast portions are articulated as shown in FIG. 5 or FIG. 6.

The support beams 20 have thus far been attached to opposite sides of the vehicle body 14 and positioned horizontally above the vehicle cab 18.

Referring to FIG. 7, alternative support beams 202 comprises a pair of first vertical portions 204 positioned in front of the vehicle cab 18, a pair of horizontal portions 206 positioned above the vehicle cab 18 and a second pair of vertical portions 208 positioned between the rear of vehicle cab 18 and the front of vehicle body 14. One end of the first vertical portions 204 are attached to the front of vehicle chassis 12 and a pair of ninth pins 212 are disposed through the vehicle chassis 12 and first vertical portions 204 to enable the first vertical portions to move pivotally about an axis which includes the ninth pins 212. The other end of the first vertical portions 204 are rigidly connected to one end of the horizontal portions 206 whose other end is rigidly connected to one end of the second vertically portions 208. The other end of the second vertical portions 208 are secured to the vehicle utilizing a manual locking device 214. The frame 30 and lift mechanism utilized may be any of those described above. When the lock mechanism 214 is released the support beam 202 may rotate forwardly to enable the vehicle cab 18 to also tilt forwardly concurrently.

Referring to FIG. 8, the support beams 202 are positioned closer to the center of the vehicle cab 18 than the support beams 20 shown in FIG. 2. In fact, support beams 202 are aligned with the frame of chassis 12. Positioning the support beams 202 closer to the center of the vehicle chassis 18 further reduces the width added to the vehicle 10.

From the foregoing, it has been shown that the present invention provides a refuse vehicle having a lift apparatus which enables the size of the support beams, frame and hydraulic cylinders to decrease compared to those in the prior art. This enables a decrease in vehicle weight and therefore saves fuel and increases the load the vehicle may carry. Additionally, the smaller hydraulic cylinders enables less fuel consumption, less noise, and more speed. The present invention also provides a lift apparatus which significantly increases the width of the hopper opening thereby enabling the hopper opening to be wider than those in the prior art. This wider hopper opening prevents damage to refuse container lids and reduces the spillage of litter when the containers are emptied through the hopper opening. The present invention also enables the vehicle to utilize a detachable body to provide optimal flexibility of the transfer of refuse. Although a specific embodiment of the invention has been illustrated and described, various modifications and changes may be made without department from the spirit and scope of the invention.

What is claimed is:

1. Apparatus for emptying a refuse container into a vehicle having a chassis, a cab mounted to the front of the chassis, and a body mounted to the chassis behind the cab, the body having an opening for receiving the contents of the container, comprising:

means for engaging the refuse container;

first and second support beams positioned over the cab on opposite sides of the vehicle body and extending horizontally in front of the vehicle cab;

a frame movable between a lowered condition and a raised condition, the frame having first and second masts positioned in front of the cab when the frame is in the lowered condition, a first arm having one end coupled to the first mast and the other end mounted to the first support beam for pivotal movement about a horizontal axis above and between the front and rear of the cab, a second arm having one end coupled to the second mast and the other end mounted to the second support beam for pivotal movement about the horizontal axis;

first actuating means for enabling the frame to move between said lowered and raised condition;

drive means mounted to the frame for enabling the container-engaging means to move along a path provided by the first and second masts; and means for tilting the container-engaging means rearwardly relative to the first and second masts when the frame is in the raised condition.

2. The apparatus as defined in claim 1 wherein the first arm is rigidly connected to the first mast and the second arm is rigidly connected to the second mast.

3. The apparatus as defined in claim 2 wherein the tilting means comprises a sub-frame disposed on said first and second masts;

said sub-frame enabling pivotal movement about said preselected axis between a first position in which the sub-frame is substantially aligned with the first and second masts and a second position in which the sub-frame is tilted backwardly relative thereto; and second actuating means for enabling the sub-frame movement between said first and second positions.

4. The apparatus as defined in claim 3 wherein the first and second masts are segmented, one segmented portion of each mast being positioned downward when the frame is in the raised condition.

5. The apparatus as defined in claim 4 wherein:

the guide means comprises a first portion associated with the first and second masts and a second portion associated with the sub-frame, the first and second portions being aligned when the sub-frame is in said first portion thereof.

* * * * *